US008246046B2

(12) United States Patent
Taniyama et al.

(10) Patent No.: US 8,246,046 B2
(45) Date of Patent: Aug. 21, 2012

(54) SHEET HANDLING DEVICE

(75) Inventors: Yukie Taniyama, Nagoya (JP); Hiroki Matsuse, Owariasahi (JP); Riichi Kato, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 110 days.

(21) Appl. No.: 12/265,784

(22) Filed: Nov. 6, 2008

(65) Prior Publication Data

US 2009/0134567 A1 May 28, 2009

(30) Foreign Application Priority Data

Nov. 7, 2007 (JP) ..... 2007-289758

(51) Int. Cl.
*B65H 7/02* (2006.01)
*B65H 43/00* (2006.01)

(52) U.S. Cl. ..... 271/258.01; 271/3.14; 271/3.18

(58) Field of Classification Search ..... 271/3.18, 271/3.19, 3.13–3.15, 256, 258.01, 3.01
See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 4,625,870 | A * | 12/1986 | Nao et al. | 209/534 |
| 6,435,329 | B1 | 8/2002 | Amari et al. | |
| 6,796,434 | B2 * | 9/2004 | Kako et al. | 209/603 |
| 2001/0052667 | A1 * | 12/2001 | Mochizuki et al. | 271/3.14 |
| 2002/0096816 | A1 * | 7/2002 | Sasaki et al. | 271/3.14 |
| 2002/0153291 | A1 * | 10/2002 | Otsuka | 209/534 |
| 2002/0180136 | A1 * | 12/2002 | Amari et al. | 271/3.14 |
| 2005/0202771 | A1 * | 9/2005 | Shimizu et al. | 453/1 |
| 2008/0150224 | A1 * | 6/2008 | Shimizu et al. | 271/263 |
| 2009/0166948 | A1 * | 7/2009 | Yui | 271/3.14 |

FOREIGN PATENT DOCUMENTS

| | | | |
|---|---|---|---|
| EP | 1548662 | A2 | 6/2005 |
| EP | 1571603 | A1 | 9/2005 |
| EP | 1755088 | A1 | 2/2007 |
| JP | 6-295369 | | 10/1994 |
| JP | 991494 | | 4/1997 |
| JP | 09198544 | | 7/1997 |
| JP | 200351050 | | 2/2003 |
| JP | 2003272027 | | 9/2003 |
| JP | 2004280226 | | 10/2004 |
| JP | 2005250642 | | 9/2005 |

OTHER PUBLICATIONS

Notice of Reasons for Refusal, issued by the Korean Patent Office on Oct. 29, 2010, in counterpart Korean Patent Application along with English language translation.
Office Action, issued by the Chinese Patent Office on May 26, 2010, in counterpart Chinese Patent Application along with English language translation.
Foreign Office Action (Decision of Rejection) dated Apr. 3, 2012.

* cited by examiner

*Primary Examiner* — Kaitlin Joerger
*Assistant Examiner* — Patrick Cicchino
(74) *Attorney, Agent, or Firm* — Brundidge & Stanger, P.C.

(57) ABSTRACT

[Problem] The present invention has as an object to reduce the occurrence of jamming of sheet within a sheet handling device.
[Solution] The sheet handling device comprises an input/output section having the function of stacking sheets and configured to accept and dispense sheets from the sheet handling device; a storing unit configured to store sheets; a transport path allocated between the storing unit and the input/output section and configured to transport sheets; a determination section allocated on the transport path and configured to determine transport condition of sheets being transported; and a controller that, in the event that the determination section determines improper transport condition of a sheet being transported from the storing unit to the input/output section by the transport path, controls the transport path so as to store the sheet in the storing unit.

8 Claims, 6 Drawing Sheets

SHEET HANDLING DEVICE

BACKGROUND OF THE INVENTION

1. Field of the Invention

The present invention relates to a sheet handling device.

2. Description of the Related Art

Sheet handling devices which are configured to handle sheets such as banknotes and checks are widely employed as automatic teller machines and the like by financial institutions. Such a sheet handling device have an internal transport path for transporting sheets. However, due to soiling or tearing of sheets being handled or to the design of the transport path, the problem of jamming of sheets within the device sometimes arises, necessitating shutting down operation of the device. According to one known technology addressed to this problem, when a sheet becomes jammed, the jammed sheet is diverted onto an alternate path so as to minimize the need to shut down operation of the device.

However, in most instances a sheet jam inside a device will occur when sheets are stacked in a input/output hopper etc., and thus while the technology mentioned above is effective in determining and eliminating sheet jams occurring on the transport path, a weakness is that it not capable of dealing with instances of sheet jams due to stacking of sheets in the input/output hopper subsequent to transfer to the input/output hopper.

SUMMARY OF THE INVENTION

It order to address the above problem at least in part, it is accordingly one object of the present invention to reduce the occurrence of sheet jams within a device.

The present invention is addressed to attaining the above objects at least in part according to the following aspects of the invention.

A first aspect of the present invention provides a sheet handling device. The sheet handling device according to the first aspect of the present invention comprises: an input/output section having the function of stacking sheets and configured to accept and dispense sheets from the sheet handling device; a storing unit configured to store sheets; a transport path allocated between the storing unit and the input/output section and configured to transport sheets; a determination section allocated on the transport path and configured to determine a transport condition of sheets being transported; and a controller that, in the event that the determination section determines an improper transport condition of a sheet being transported from the storing unit to the input/output section by the transport path, controls the transport path so as to store the sheet in the storing unit.

According to the sheet handling device of the first aspect of the present invention, a sheet determined to have an improper transport condition that poses a risk of jamming if stacked in the input/output section is transported to the storing unit without being transported to the input/output section, so that jamming in the input/output section can be avoided.

The sheet handling device according to the first aspect of the present invention may further comprise an repository unit configured to reposit sheets; the transport path may include a first transport path allocated between the repository unit, the storing unit, and the determination section, and a second transport path allocated between the determination section and the input/output section; and in the event that the determination section has determined an improper transport condition of a sheet of interest that was transported from the repository unit to the determination section by the first transport path, the sheet of interest is transported to the storing unit after other sheets on the first transport path have been transported to the repository unit. In this case, even where a plurality of sheets separated from the repository unit, and the determination section has determined an improper transport condition of a sheet of interest in the lead position, by first transporting the second and subsequent sheets on the first transport path to the repository unit, the sheet of interest in the lead position can be transported to the storing unit on the first transport path.

In the sheet handling device according to the first aspect of the present invention, the controller may, after transporting the sheet of interest onto the second transport path by the first transport path and the second transport path, then transport other sheets on the first transport path to the repository unit and transport the sheet of interest to the storing unit. In this case, during transport of the second and subsequent sheets to the repository unit, the sheet of interest may be initially queued on the second transport path, and the sheet of interest then transported to the storing unit after the second and subsequent sheets have been transported to the repository unit.

The sheet handling device according to the first aspect of the present invention may further comprise a temporary repository unit allocated on the second transport path and configured to temporarily reposit sheets; the determination section, with regard to a sheet determined to have an improper transport condition, may further decide whether transport thereof to the temporary repository unit is possible; and on the basis of the decision, the controller may transport the sheet to the temporary repository unit by the second transport path. By so doing, a sheet determined to have an improper transport condition, for example, by virtue of being counterfeit, can be deposited in a temporary reposit storing unit.

The sheet handling device according to the first aspect of the present invention may further comprise a sensing section configured to determine whether a sheet is present straddling the first transport path and the second transport path; and during transport of the sheet of interest on the second transport path, the controller may control the first transport path and the second transport path based on the sensed results by the sensing section. In this case, since the sensing section determines the presence or absence of a sheet straddling the first transport path and the second transport path, and the controller controls the two transport paths, damage to a sheet straddling the two transport paths resulting from driving of the two transport paths can be reduced.

In the sheet handling device according to the first aspect of the present invention, the improper transport condition may be one of transport of a sheet in a skewed and shifted condition on a transport path. In this case, it is possible to reduce the occurrence of jamming during stacking in the input/output section, due to sheets being transported in skewed and shifted condition on a transport path.

The present invention may be reduced to practice in various other aspects besides those taught hereinabove. Such other possible aspects include, for example, an automatic teller machine equipped with a sheet handling device; a sheet handling method for handling sheets; or a computer program for handling sheets.

The sheet handling device according to the present invention will be shown hereinbelow on the basis of certain preferred embodiments with reference to the accompanying drawings in which.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DESCRIPTION OF THE PREFERRED EMBODIMENTS

A. Configuration of Automatic Teller Machine

Figure 1:
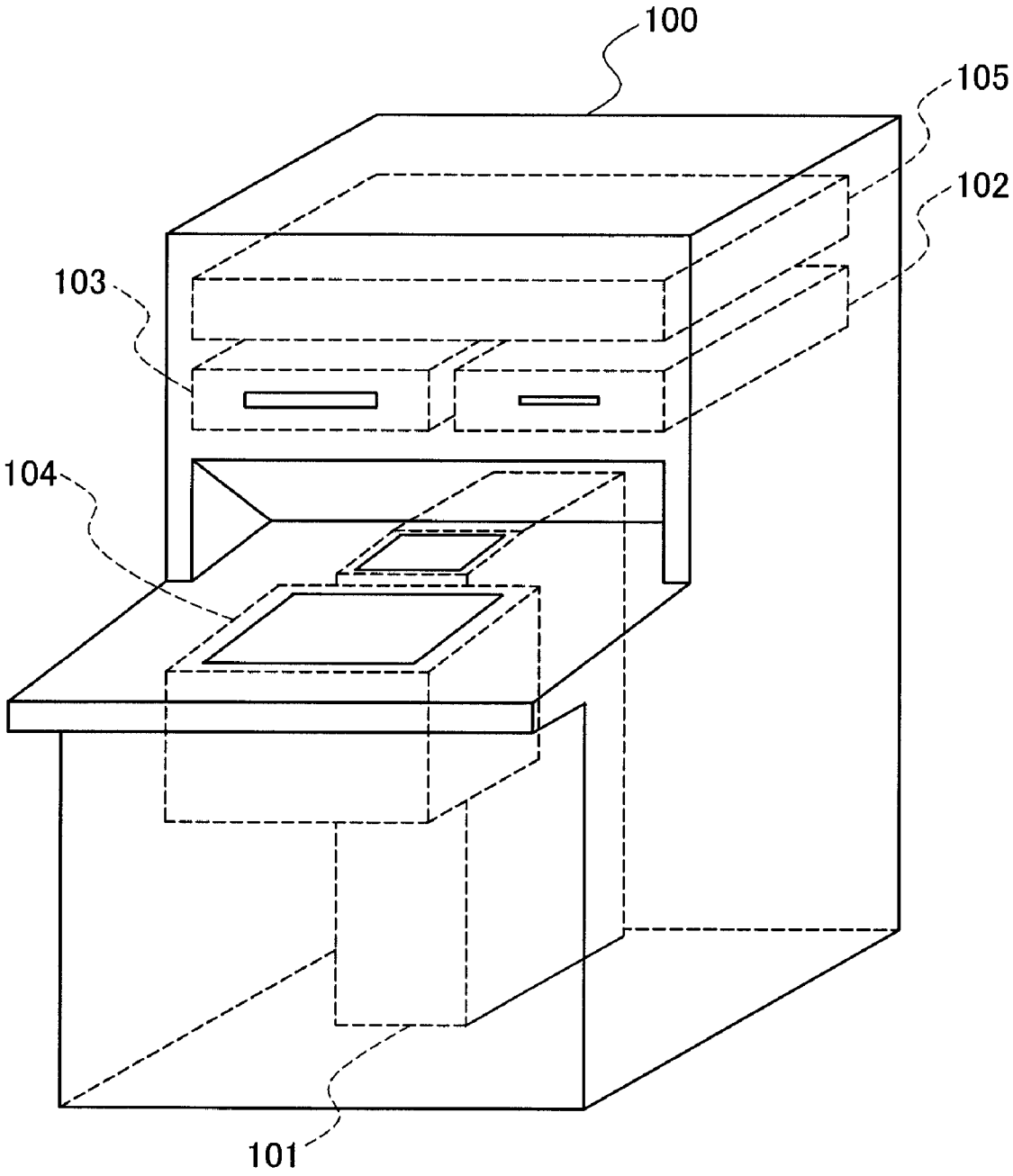
FIG. 1 shows an exterior view of an automatic teller machine as one embodiment of the present invention.

FIG. 1 shows an exterior view of an automatic teller machine as one embodiment of the present invention. This automatic teller machine 100 might be located in a bank or convenience store for example, and is configured to perform transactions such as accepting deposits and dispensing cash in response to user operations. As shown, the automatic teller machine 100 includes a sheet handling device 101, a card/receipt processing unit 102, a passbook processing device 103, a user operation section 104, and a main control unit 105.

The sheet handling device 101 is a device for carrying out cash transactions with users, and also has the functions of discriminating among banknotes, and of sorting and storing banknotes of different denominations. The sheet handling device 101 will be discussed in detail later.

The card/receipt processing unit 102 reads information that has been recorded onto a debit card, as well as issuing transaction receipts recording the details of a transaction. The passbook processing device 103 performs reading of information entered in a passbook, printing processes, and so on. The user operation section 104 is an interface that displays guide screens for guiding the user through deposit or withdrawal transactions etc., and that enables user input during deposit or withdrawal transactions. In this embodiment, a touch panel is employed; however, an arrangement composed of a display and push buttons etc. would also be acceptable.

The main control unit 105 is constituted as a computer having an internal CPU, memory, etc. (not shown). The main control unit 105 exchanges information with the sheet handling device 101, the card/receipt processing unit 102, the passbook processing device 103, and the user operation section 104, and controls the overall operation of the automatic teller machine 100.

B. Configuration of Sheet Handling Device

Figure 2:
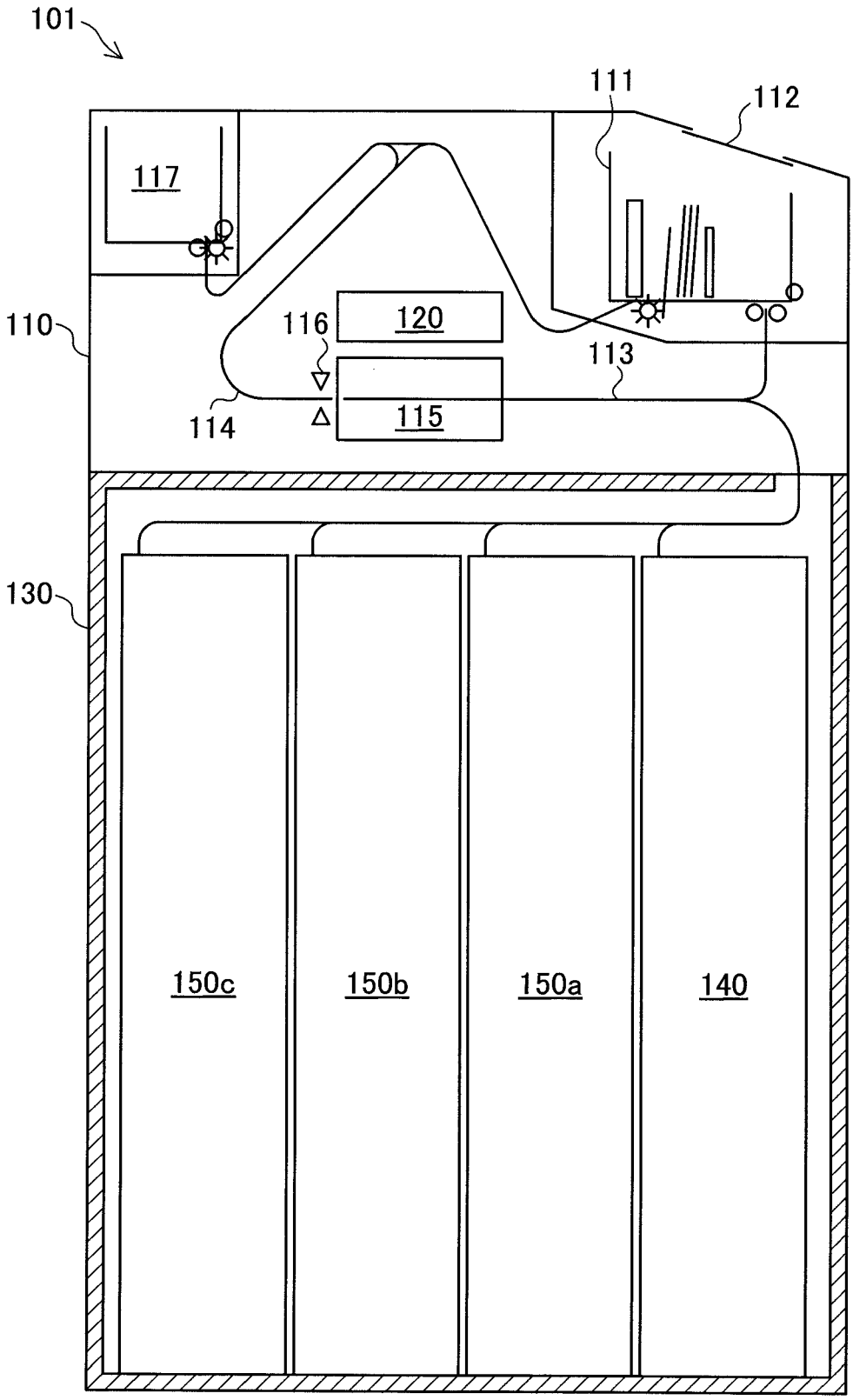
FIG. 2 shows simplified configuration of a sheet handling device.

FIG. 2 shows a simplified configuration of a sheet handling device. The drawing depicts the sheet handling device 101 in side sectional view. The sheet handling device 101 of this embodiment is a device of so-called "cash recycling" design configured to re-dispense, for the purpose of dispensing cash, deposited banknotes that have been reposited. However, the sheet handling device 101 could instead be a device of non-recycling design that does not subsequently re-dispense deposited banknotes once reposited.

As depicted in FIG. 2, the sheet handling device 101 includes an upper unit 110 and a safe unit 130. The upper unit 110 is provided with a cash accepting/dispensing portion 111 having a shutter 112 at a banknote accepting/dispensing slot; transport paths 113, 114; a determination section 115; a sensing section 116; a temporary repository unit 117; and a control unit 120.

The cash accepting/dispensing portion 111 has a cash accepting/dispensing box for accepting and dispensing banknotes from and to users; pickup and feed rollers for feeding banknotes to a transport path (discussed later) from the cash accepting/dispensing box; a transport roller for feeding in banknotes to the cash accepting/dispensing box from a transport path; and a vane roller for truing up the position of fed-in banknotes. The shutter 112 opens and closes in response to operation of the user operation section 104 by the user. The cash accepting/dispensing portion 111 corresponds to the input/output section in the appended claims.

The transport paths 113, 114 carry out transport of banknotes inside the sheet handling device 101. The transport path 113 is allocated so as to be configured to transporting banknotes between the safe unit 130 and the transport path 114. The transport path 114 is allocated so as to be configured to transporting banknotes between the transport path 113 and the cash accepting/dispensing portion 111. While not depicted in the drawing, the transport paths 113, 114 have conveyor belts arranged so as to hold banknotes between them; a plurality of rollers; drive motors for driving the plurality of rollers; and so on. At branching portions of the transport paths 113, 114 there are respectively allocated gates, which are driven by an electromagnetic solenoid for example and are used to switch the transport destination of banknotes. In this embodiment, the direction of transport of banknotes coincides with the direction of the short side of the banknotes. The transport path 113 corresponds to the first transport path in the appended claims, and the transport path 114 corresponds to the second transport path in the appended claims.

The determination section 115 is allocated on the transport path 113 and in proximity to the transport path terminus where banknotes are shuttled to and from the transport path 114. The determination section 115 has various kinds of sensors, and discriminates the denomination and suitability for recycling (e.g. the authenticity and condition of damage of banknotes) of banknotes transported by the transport paths 113, 114, and outputs the results. Discrimination of banknotes can be carried out using information of various kinds such as image data obtained by scanning banknotes; or their magnetic characteristics, optical characteristics with respect to ultraviolet, and so on. Various kinds of sensors can be used as sensors for carrying out discrimination, such as contact type sensors, reflection type sensors, transmission type sensors, color sensors, ultraviolet sensors, and the like. Also, several types of sensors may be combined to carry out discrimination.

The sensing section 116 is allocated on the transport path 114 and in proximity to the transport path terminus where banknotes are shuttled to and from the transport path 113. A sensor provided to the sensing section 116 senses whether any banknotes straddle the transport path 113 and the transport path 114, and outputs the result.

The temporary storing unit 117 is allocated on the transport path 114 and temporarily reposits banknotes that are in transit in the process of deposit or withdrawal. The temporary repository storing unit 117 has a pickup roller and a feed roller for feeding banknotes from a temporary repository unit to the transport path 114; a transport roller for feeding in banknotes from the transport path 114 to the temporary repository unit; and a vane roller for truing up the position of the fed-in banknotes.

The safe unit 130 is encased by thick plates of metal and is of strong construction. The safe unit 130 includes three recycling repositories 150*a*, 150*b*, 150*c* for collecting and reposting good banknotes that are suitable for use in withdrawals; and with one reject storing unit 140 for collecting and storing banknotes that are unsuitable for recycling or transactions, such as appreciably damaged banknotes (hereinafter termed reject banknotes). The recycling repositories 150*a*, 150*b*, 150*c* and the reject storing unit 140 are connected to the transport path 113, and shuttle banknotes to and from the transport path 113. The recycling repositories 150*a*, 150*b*, 150*c* are furnished with pickup rollers and feed rollers for taking collected banknotes and feeding them to the transport path 113; and with transport rollers for feeding in banknotes to the recycling repositories 150*a*, 150*b*, 150*c* from the transport path 113. The recycling repositories 150*a*, 150*b*, 150*c* correspond to the repository unit in the appended claims, and the reject storing unit 140 corresponds to the storing unit in the appended claims.

In this embodiment, the recycling storing unit 150*a* is a ¥10,000 storing unit that stores ¥10,000 bills; the recycling storing unit 150*b* is a ¥5,000 storing unit that stores ¥5,000 bills; and the recycling storing unit 150*c* is a ¥1,000 storing unit that stores ¥1,000 bills. The sheet handling device 101 could also be provided with a ¥2,000 storing unit that stores ¥2,000 bills. While the sheet handling device 101 in this embodiment has been designed to handle Japanese currency, it could also be designed to handle foreign currency.

The reject storing unit 140 is a device that stores reject banknotes of different denominations and different sizes by collecting them mixed together. In this embodiment, the sheet handling device 101 is provided with a single reject storing unit 140. However, an arrangement having a plurality of reject repositories 140 would also be acceptable.

Figure 3:
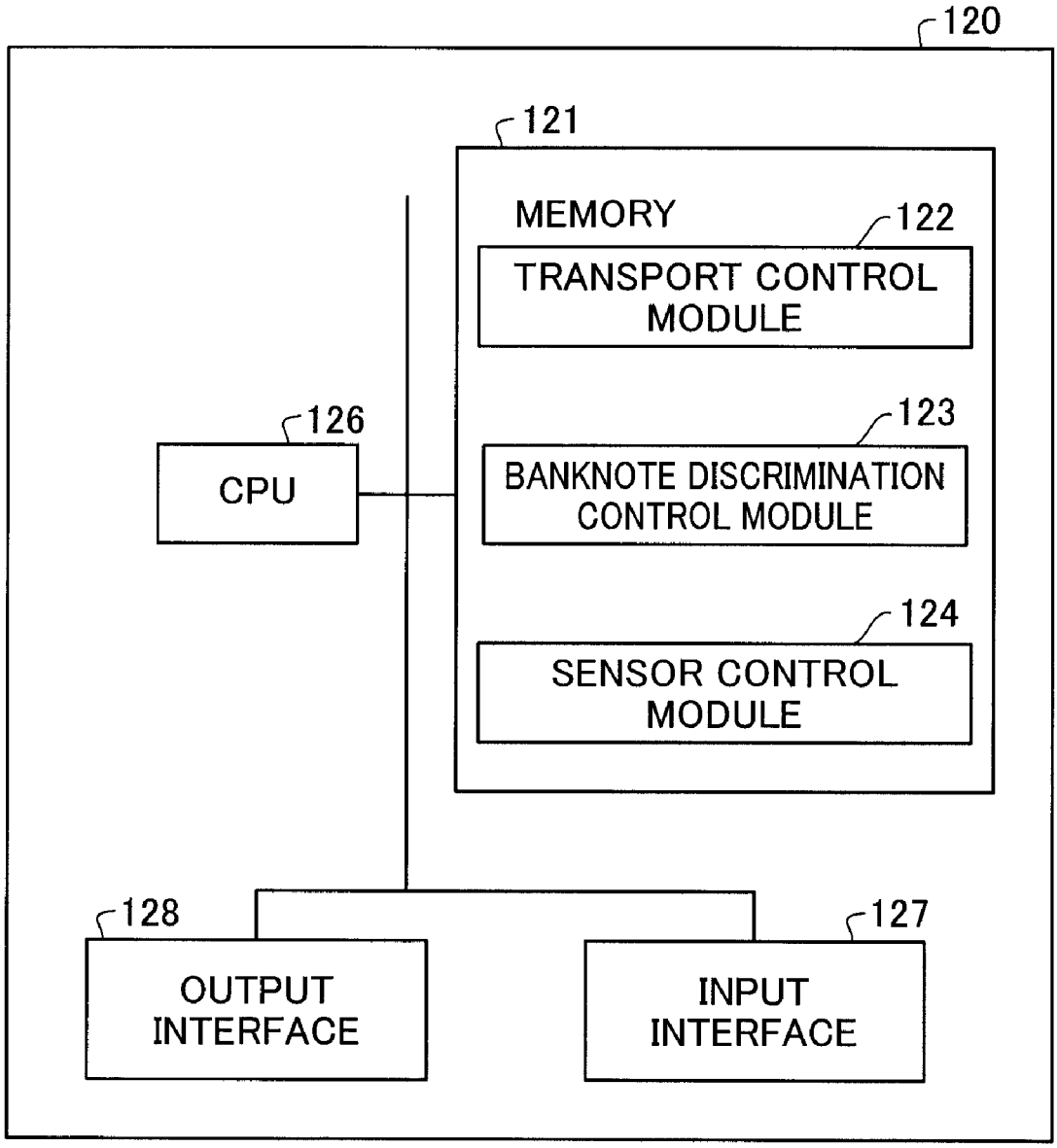
FIG. 3 shows block diagram of the internal configuration of a control unit.

FIG. 3 shows a block diagram of the internal configuration of a control unit. The control unit 120 includes a memory 121, a CPU 126, an input interface 127, and an output interface 128. The CPU 126 is a central processing unit, and controls the parts of the sheet handling device 101. The memory 121 is composed of ROM and RAM, and stores programs for execution of specific processes by the CPU 126, namely, a transport control module 122, a banknote discrimination control module 123, and a sensor control module 124. The CPU 126 controls operation of the transport paths 113, 114 by executing the transport control module 122. The CPU 126 controls operation of the determination section 115 by executing the banknote discrimination control module 123. The CPU 126 controls operation of the sensing section 116 by executing the sensor control module 124. In this embodiment, software is depicted by way of the method of controlling the sections of the sheet handling device 101, but control could instead be realized through hardware, such as integrated circuits.

The input interface 127 presents the CPU 126 with cash dispense and other commands output from the main control unit 105, as well as with information output by the determination section 115 such as denominations and suitability for recycling (e.g. the authenticity and condition of damage of banknotes) of banknotes, and with information output by the sensing section 116 regarding the presence of banknotes on the transport paths. The output interface 128 sends operation commands by the CPU 126 to other parts of the sheet handling device 101.

C. Operation of Sheet Handling Device

Figure 4:
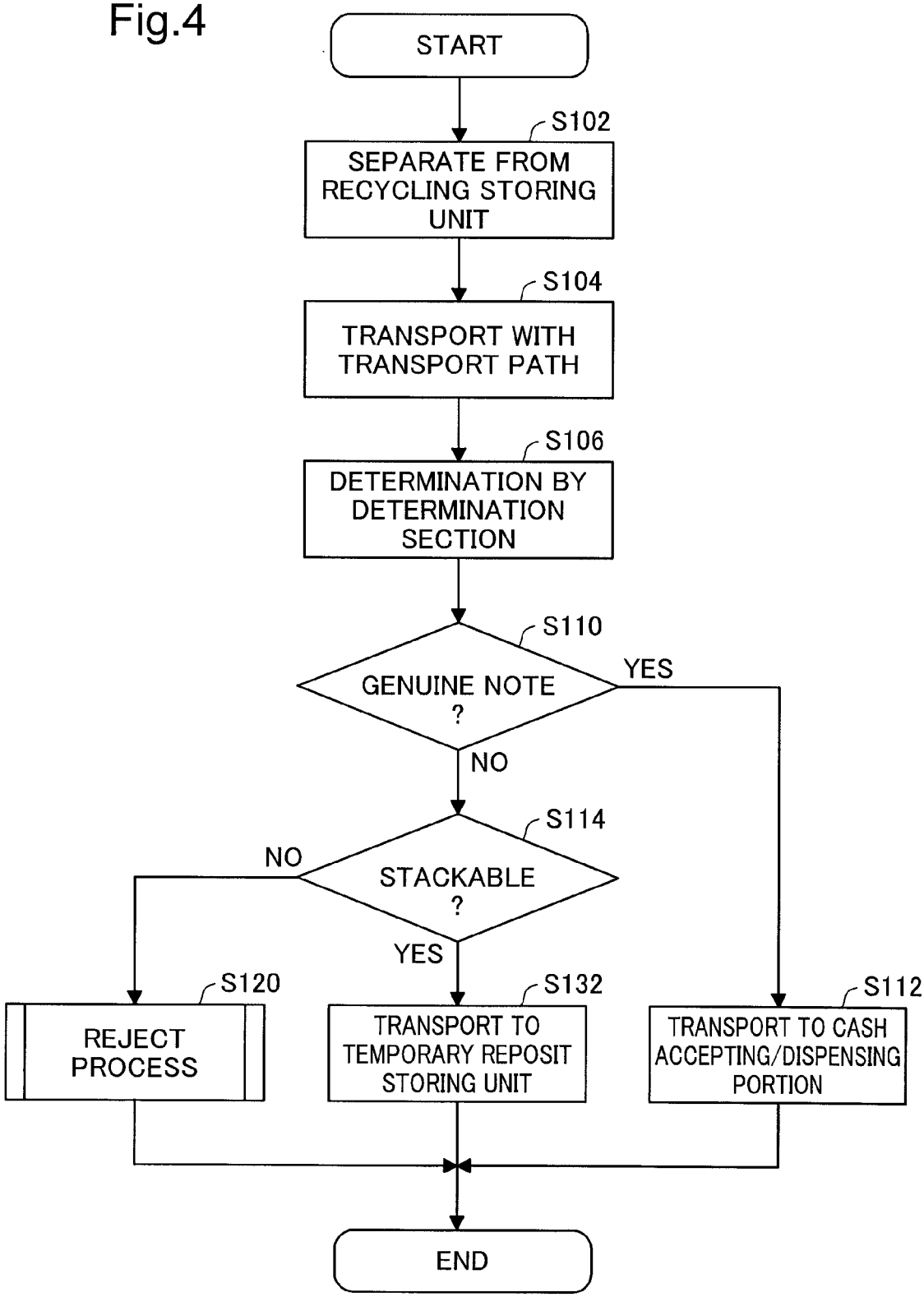
FIG. 4 is a flowchart showing operation of a sheet handling device.

The operation of the sheet handling device according to the present invention will now be described. FIG. 4 is a flowchart showing operation of a sheet handling device. The main control unit 105 produces a cash dispense command based on a withdraw cash operation made by a user from the user operation section 104, and transmits it to the control unit 120. The CPU 126 of the control unit 120 then receives the cash dispense command, and performs separation of appropriate banknotes currently stored in the recycling repositories 150*a*, 150*b*, 150*c* (Step S102). Specifically, on the basis of the cash dispense command, the pickup and feed rollers (not shown) of the storing unit or repositories in which the different denominations are stored is controlled to separate the appropriate banknotes, which then are fed onto the transport path 113. Here, in this embodiment, the direction in banknotes are transported from the reject storing unit 140 and the recycling repositories 150*a*, 150*b*, 150*c* to the cash accepting/dispensing portion 111 and the temporary repository unit 117 transport shall be termed the forward direction, and the opposite direction as the reverse direction.

The CPU 126 then transports the banknotes that have been separated from the recycling repositories 150*a*, 150*b*, 150*c* to the determination section 115 over the transport path 113 (Step S104). The CPU 126 transports the banknotes in the forward direction by controlling the drive motor of the transport path 113 and the gates at the branching portions on the transport path 113. The determination section 115 determines whether the banknotes transported by the transport path 113 are genuine (Step S106), and transmits the determination results to the CPU 126. Banknotes determined as not being genuine may include banknotes that, while genuine, cannot be read correctly by the determination section 115 due to skew, whereby the banknote moves over the transport path in an oblique attitude, or to a shifted condition whereby the banknote moves over the transport path in a condition shifted to either the left or right, and as such have been determined to be not genuine.

If the determination section 115 has determined that a banknote is genuine (Step S110: YES), the CPU 126 controls the transport path 113 and the transport path 114, and transports the banknote to the cash accepting/dispensing portion 111 (Step S112). After transport, the CPU 126 stacks the banknotes using the vane roller of the cash accepting/dispensing portion 111, and opens the shutter 112. This allows the user to withdraw the banknotes.

If the determination section 115 has determined that a banknote is not genuine (Step S110: NO), the determination section 115 does not further attempt to determine whether the banknote is skewed or shifted. If a banknote is skewed or shifted, the determination section 115 decides from the extent thereof whether the banknote is stackable by the vane roller of the temporary repository unit (Step S114). The determination section 115 then sends the result of the decision to the CPU 126.

If the determination section 115 has decided that the banknote is stackable by the vane roller in the temporary repository unit (Step S114: YES), the CPU 126 switches the gate (not shown) on the transport path 114 and transports the banknote to the temporary repository unit 117. If the determination section 115 has decided that the banknote cannot be stacked by the vane roller in the temporary repository unit (Step S114: NO), the CPU 126 executes a reject process, discussed later (Step S120).

Figure 5:
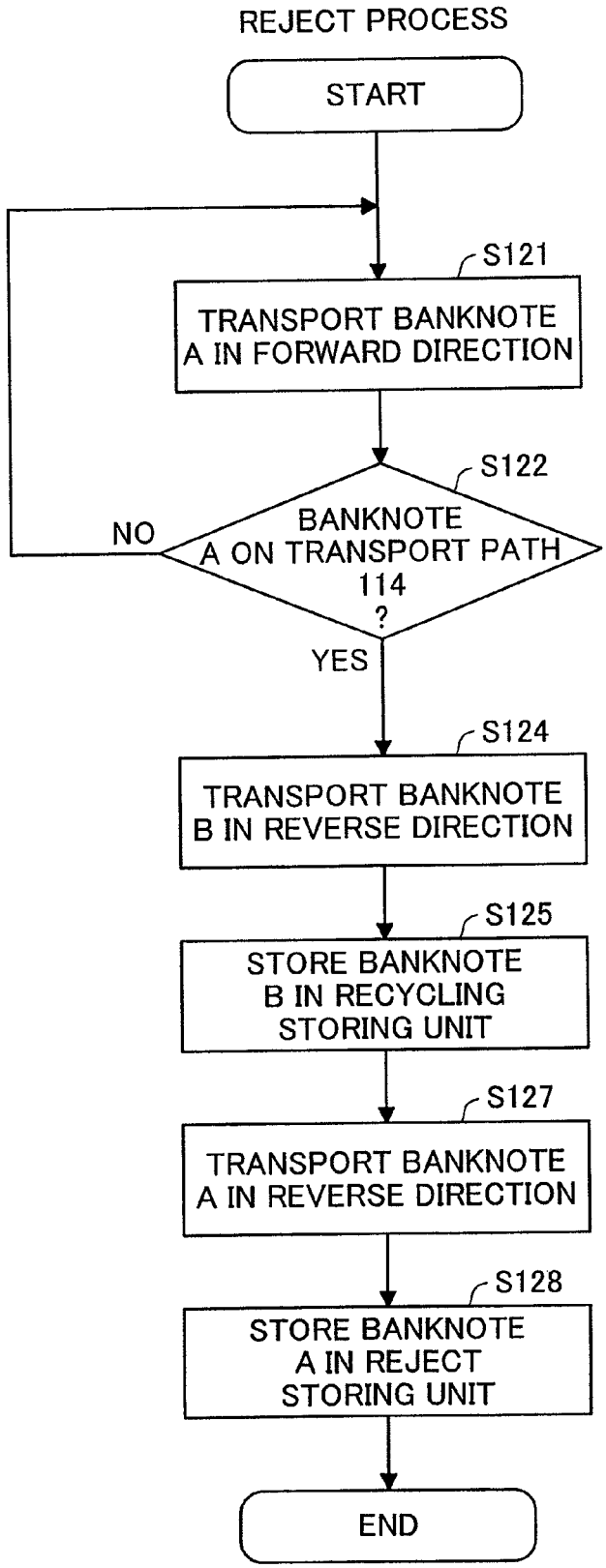
FIG. 5 is a flowchart showing a reject process.
Figure 6A:
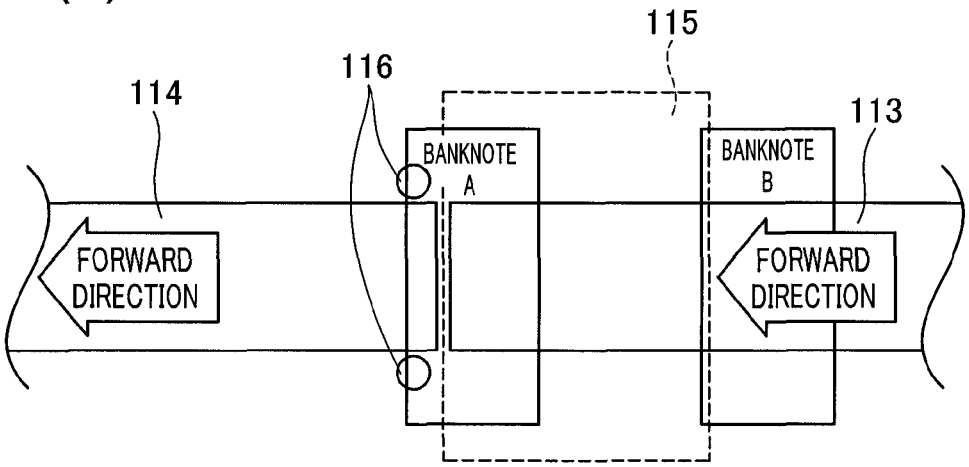
FIGS. 6 (*a*) to (*c*) show a frame format of transport of banknotes in proximity to a determination section.
Figure 6B:
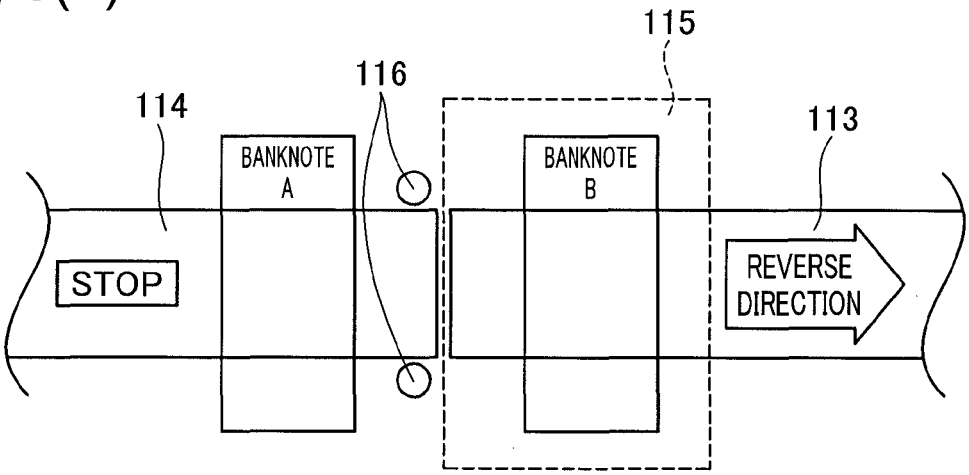
Figure 6C:
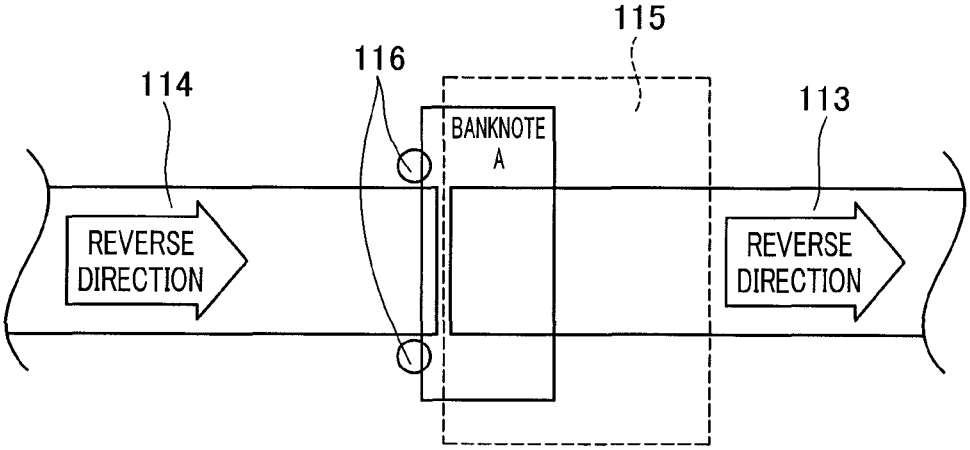

FIG. 5 is a flowchart showing a reject process. FIG. 6 shows a frame format of transport of banknotes in proximity to the determination section. A banknote that the determination section 115 has determined cannot be stacked in the temporary repository unit is denoted as Banknote A; Banknote A is followed by a Banknote B that has been separated from a recycle storing unit and is moving in the forward direction along the transport path 113 following Banknote A.

After determination of Banknote A by the determination section 115, the CPU 126 controls the transport path 113 and the transport path 114, and transport Banknote A in the forward direction (Step S121). FIG. 6 (*a*) depicts Banknote A having been determined by the determination section 115 and being transported in the forward direction by the transport paths 113, 114. If Banknote A is in a condition straddling the transport path 113 and the transport path 114, the sensing section 116 determines the presence of the banknote and sends the information to the CPU 126. On the basis of the information from the sensing section 116, the CPU 126 controls the transport path 113 and the transport path 114 and transport Banknote A in the forward direction until the sensing section 116 no longer determines the banknote (Step S122:NO).

Once Banknote A is no longer straddling the transport path 113 and the transport path 114 (Step S122: YES), the sensing section 116 sends the CPU 126 information to the effect that the banknote is no longer sensed, whereupon as depicted in FIG. 6 (*b*), the CPU 126 halts the transport path 114 and queue Banknote A on the transport path 114, then drives the transport path 113 in reverse so that Banknote B on the transport path 113 is now transported back to the recycling storing unit in which Banknote B was originally stored (Step S124).

Once Banknote B has been stored in the recycling storing unit (Step S125), as depicted in FIG. 6 (*c*) the CPU 126 turns the transport path 114 in the reverse direction to transport Banknote A to the transport path 113. In addition to turning the transport path 113 in the reverse direction, the gate is switched, and Banknote A is transported to the reject storing unit 140 (Step S127). Once Banknote A is stored in the reject storing unit (Step S128), the CPU 126 terminates the operation.

According to the sheet handling device of this embodiment, skewed or shifted banknotes that pose a risk of jamming when stacked in the cash accepting/dispensing portion 111 can be transported to the reject storing unit 140 instead of being transported to the cash accepting/dispensing portion 111. The incidence of jamming of banknotes in the input/output section can be reduced thereby.

According to the sheet handling device of this embodiment, even where a plurality of banknotes have been separated from the recycling repositories 150*a*, 150*b*, 150*c*, and improper transport condition of a banknote of interest in the lead position has been determined by the determination section, owing to the provision of two transport paths, namely, the transport path 113 and the transport path 114, the banknote of interest may be queued on the transport path 114, and the banknote or banknotes on the transport path 113 may then be transported to the recycling repositories 150*a*, 150*b*, 150*c* so that the banknote of interest can be transported to the reject storing unit.

According to the sheet handling device of this embodiment, owing to the provision of the temporary repository unit 117 on the transport path 114, it is possible to store counterfeit notes and banknotes that cannot be transported to the input/output section but that are transportable to the temporary repository unit.

According to the sheet handling device of this embodiment, by having the sensing section 116 sense the presence or absence of banknotes straddling the transport path 113 and the transport path 114, damage to a sheet straddling the two transport paths resulting from driving of the two transport paths in separate directions can be reduced.

D. Modified Embodiments

The present invention may be embodied in various other modes without departing from the scope and spirit thereof.

D1. Modified Embodiment 1

While the embodiment was implemented for multiple transport paths, implementation for a single transport path would also be possible. For example, where switching of gates provided on the transport path is carried out concomitantly with transport of banknotes, banknotes can be transported in order to their destinations even where a plurality of banknotes are present on the transport path.

D2. Modified Embodiment 2

While a sensing section 116 was provided in the embodiment, implementation without providing the sensing section 116 would be possible as well. [In the embodiment,] banknotes that the determination section 115 has determined as being unstackable in the temporary repository unit are sensed by the sensing section 116 when they straddle the transport path 113 and the transport path 114; however, banknotes could instead be prevented from straddling the transport paths by moving the banknotes for a prescribed distance in the forward direction subsequent to determination by the determination section 115.

D3. Modified Embodiment 3

While a temporary repository unit 117 was provided in the embodiment, implementation without providing the temporary repository unit 117 would be possible as well. For example, all banknotes that the determination section 115 has determined as having improper transport condition could be transported to the reject storing unit 140.

D4. Modified Embodiment 4

While the embodiment described operation of the sheet handling device during a withdrawal transaction by a user, implementation is also possible in relation to operation of a sheet handling device in the event that, for example forgotten banknotes have been left in the cash accepting/dispensing portion 111, whereby the forgotten banknotes may be recovered to the recycling repositories.

D5. Modified Embodiment 5

In the embodiment, the reject storing unit 140 is allocated on the transport path 113, but could be allocated on the transport path 114 instead.

D6. Modified Embodiment 6

In the embodiment, the temporary repository unit is provided with a pickup roller and a feed roller for feeding [banknotes] to the transport path 114; with a transport roller for feeding in banknotes to the temporary repository unit from the transport path 111; and with a vane roller for truing up the position of fed-in banknotes; however, a mechanical winding system whereby banknotes are stored in the order of transport, banknotes are dispensed in the reverse order, and banknotes are retained by a belt wound about the perimeter of a rotating drum would also be acceptable.

The present invention may be reduced to practice in various other modes besides those taught hereinabove, for example, an automatic teller machine equipped with a sheet handling device; a sheet handling method for handling sheets; a computer program for handling sheets, a computer readable medium storing a computer program for handling sheets.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

The following Japanese patent application as the basis of the priority claim of this application is incorporated in the disclosure hereof by reference:

Japanese Patent Application No. 2007-289758 (filing date: Nov. 7, 2007).

What is claimed is:

1. A sheet handling device comprising:

input and output section that stacks sheets and accepts and dispenses sheets from the sheet handling device;

a storing unit that stores sheets;

a repository unit that reposits sheets;

a transport path that transports sheets, wherein the transport path is allocated between the storing unit, the repository unit, and the input and output section;

a determination section allocated on the transport path and that determines transport conditions of sheets being transported; and a controller, wherein when the determination section determines an improper transport condition of a sheet being transported from the repository unit to the input/output section by the transport path, the controller controls the transport path so as to store the sheet in the storing unit, wherein the transport path includes:

a first transport path allocated between the repository unit, the storing unit, and the determination section; and a second transport path allocated between the determination section and the input and output section, and wherein when the determination section has determined an improper transport condition of a sheet of interest that was transported from the repository unit to the determination section by the first transport path, the sheet of interest, having the improper transport condition, is queued on the second transport path, wherein a temporary storing unit is allocated on the second transport path and temporarily reposits sheets other than the sheet of interest, the sheet of interest being queued on the second transport path without being reposited in the temporary storing unit, wherein after the sheet of interest has been queued on the second transport path, other sheets on the first transport path are transported to the repository unit, and wherein after the other sheets on the first transport path have been transported to the repository unit, the sheet of interest is transported to the storing unit.

2. The sheet handling device according to claim 1, wherein after transporting the sheet of interest onto the second transport path by the first transport path and the second transport path, the controller transports other sheets on the first transport path to the repository unit, and transports the sheet of interest to the storing unit.

3. The sheet handling device according to claim 1, further comprising:

a temporary repository unit allocated on the second transport path that temporarily reposits sheets, wherein the determination section, with regard to a sheet determined to have the improper transport condition, further makes a determination as to whether transport thereof to the temporary repository unit is possible, and wherein based on the determination as to whether transport is possible, the controller transports the sheet to the temporary repository unit by the second transport path.

4. The sheet handling device according to claim 1, further comprising:

a sensing section that senses whether a sheet is present straddling the first transport path and the second transport path, wherein during transport of the sheet of interest on the second transport path, the controller controls the first transport path and the second transport path based on the sensed results by the sensing section.

5. The sheet handling device according to claim 1, wherein improper transport conditions include transport of a sheet in a skewed and shifted condition on a transport path.

6. An automatic teller machine comprising the sheet handling device according to claim 1.

7. A sheet handling method comprising:

providing a sheet handling device that includes an input and output section that stacks sheets, and accepts and dispenses sheets, a storing unit that stores sheets, a repository unit that reposits sheets, a transport path that transports sheets, and a determination section allocated on the transport path;

transporting sheets from the repository unit to the input and output section by the transport path, wherein the transport path is allocated between the storing unit, the repository unit, and the input and output section;

determining, by the determination section, transport conditions of the transported sheets; and transporting the sheets to the storing unit based on a result of determining improper transport conditions, wherein the transport path includes a first transport path allocated between the repository unit, the storing unit, and the determination section, and a second transport path allocated between the determination section and the input and output section; and when the determination section has determined improper transport condition of a sheet of interest that was transported from the repository unit to the determination section by the first transport path, queuing the sheet of interest having the improper transport condition on the second transport path, wherein a temporary storing unit is allocated on the second transport path and temporarily reposits sheets other than the sheet of interest, the sheet of interest being queued on the second transport path without being reposited in the temporary storing unit;

after the sheet of interest has been queued on the second transport path, transporting other sheets on the first transport path to the repository unit, and after the other sheets on the first transport path have been transported to the repository unit, transporting the sheet of interest to the storing unit.

8. A computer program product comprising:

a sheet handling computer program for transporting sheets in a sheet handling device, wherein the sheet handling device includes an input and output section that stacks sheets, and accepts and dispenses sheets, a storing unit that stores sheets, a repository unit that reposits sheets, a transport path that transports sheets, and a determination section allocated on the transport path;

a computer readable storage medium having the sheet handling computer program tangibly embodied thereon, wherein the sheet handling computer program causes a computer to execute steps of:

transporting sheets from the repository unit to the input and output section by the transport path, wherein the transport path is allocated between the storing unit, the repository unit, and the input and output section;

determining, by the determination section, transport conditions of the transported sheets; and transporting the sheets to the storing unit based a result of determining improper transport conditions, wherein the transport path includes a first transport path allocated between the repository unit, the storing unit, and the determination section, and a second transport path allocated between the determination section and the input and output section; and when the determination section has determined improper transport condition of a sheet of interest that was transported from the repository unit to the determination section by the first transport path, queuing the sheet of interest, having the improper transport condition, on the second transport path, wherein a temporary storing unit is allocated on the second transport path and temporarily reposits sheets other than the sheet of interest, the sheet of interest being queued on the second transport path without being reposited in the temporary storing unit;

after the sheet of interest has been queued on the second transport path, transporting other sheets on the first transport path to the repository unit; and after the other sheets on the first transport path have been transported to the repository unit, transporting the sheet of interest to the storing unit.

* * * * *